US005816024A

United States Patent [19]

Sanfilippo et al.

[11] Patent Number: 5,816,024

[45] **Date of Patent: *Oct. 6, 1998**

[54] APPARATUS AND METHOD FOR EXPOSING PRODUCT TO A CONTROLLED ENVIRONMENT

[75] Inventors: James J. Sanfilippo, Chicago; John E. Sanfilippo, Barrington, both of Ill.

[73] Assignee: Jescorp, Inc., Des Plaines, Ill.

[ * ] Notice: The term of this patent shall not extend beyond the expiration date of Pat. No. 5,417,255.

[21] Appl. No.: 643,821

[22] Filed: May 7, 1996

[51] Int. Cl.[6] ..... B65B 31/02

[52] U.S. Cl. ..... 53/432; 53/510

[58] Field of Search ..... 53/510, 511, 512, 53/432, 434, 403, 110, 79

[56] References Cited

U.S. PATENT DOCUMENTS

| | | |
|---|---|---|
| 268,477 | 12/1882 | Fish . |
| 789,699 | 5/1905 | Lorenz . |
| 1,406,380 | 2/1922 | Heath et al. . |
| 1,639,828 | 8/1927 | Wheeler et al. . |
| 1,928,903 | 10/1933 | Manning . |
| 1,940,013 | 12/1933 | Petersen . |
| 2,131,876 | 7/1938 | Hurst . |
| 2,140,187 | 12/1938 | Kantor . |
| 2,199,565 | 5/1940 | Kantor . |
| 2,227,190 | 12/1940 | Kronquest . |
| 2,240,655 | 5/1941 | Kronquest . |
| 2,362,799 | 11/1944 | Boyd et al. . |
| 2,439,773 | 4/1948 | Hohl et al. . |
| 2,519,353 | 8/1950 | Cassady . |
| 2,521,746 | 9/1950 | Preis . |
| 2,630,958 | 3/1953 | Hohl . |
| 2,649,671 | 8/1953 | Bartelt . |
| 2,660,352 | 11/1953 | Renard . |
| 2,768,487 | 10/1956 | Day et al. . |
| 2,978,336 | 4/1961 | Morrison . |
| 3,056,244 | 10/1962 | Bartels . |
| 3,087,823 | 4/1963 | Hein et al. . |
| 3,103,771 | 9/1963 | Gräfingholt . |
| 3,117,873 | 1/1964 | Bartels et al. . |
| 3,220,153 | 11/1965 | Cormack, Jr. et al. . |
| 3,220,157 | 11/1965 | Buchner . |
| 3,340,668 | 9/1967 | Bofinger . |
| 3,347,534 | 10/1967 | Dawson . |
| 3,415,310 | 12/1968 | Kulhmann . |
| 3,466,841 | 9/1969 | Rausing . |
| 3,486,295 | 12/1969 | Rausing et al. . |
| 3,488,915 | 1/1970 | Delestatius . |
| 3,508,373 | 4/1970 | Robinson, Jr. . |
| 3,511,022 | 5/1970 | Finley et al. . |
| 3,545,160 | 12/1970 | Jantze et al. . |
| 3,584,661 | 6/1971 | Riesenberg . |
| 3,619,975 | 11/1971 | Johnson et al. . |
| 3,676,673 | 7/1972 | Coleman . |
| 3,708,952 | 1/1973 | Schulze et al. . |
| 3,747,296 | 7/1973 | Zausner ..... 53/510 |
| 3,807,052 | 4/1974 | Troue . |
| 3,837,137 | 9/1974 | Yatsushiro et al. . |
| 3,860,047 | 1/1975 | Finkelmeier et al. . |

(List continued on next page.)

FOREIGN PATENT DOCUMENTS

| | | |
|---|---|---|
| 447131 | 3/1948 | Canada . |
| 463300 | 2/1950 | Canada . |
| 1309992 | 9/1989 | Canada . |
| 33 23 710 A1 | 10/1985 | Germany . |
| 0139313 | 5/1990 | Japan . |
| WO 95/31375 | 11/1995 | WIPO . |

*Primary Examiner*—Joseph J. Hail, III
*Assistant Examiner*—Ed Tolan
*Attorney, Agent, or Firm*—Brinks Hofer Gilson & Lione

[57] ABSTRACT

Apparatus and method for exposing product to a controlled environment. The apparatus includes a distribution chamber with an inlet for receiving controlled environment or combination of gases, and a region of flow resistance. A plurality of jet nozzles are surrounded by the flow resistance region and provide high velocity streams of controlled environment which are surrounded by the low velocity streams from the resistance region. For some applications, a section of chamber immediately preceding entry into a sealer, the controlled environment supply to the jet nozzles may be shut off.

17 Claims, 5 Drawing Sheets

U.S. PATENT DOCUMENTS 3,861,116 1/1975 Domke .
3,871,157 3/1975 Domke et al. .
3,881,300 5/1975 Zetterberg .
3,910,009 10/1975 Canfield .
3,936,950 2/1976 Troue .
3,939,287 2/1976 Orwig et al. .
3,942,301 3/1976 Domke .
4,014,153 3/1977 Wilson .
4,014,158 3/1977 Rausing .
4,016,705 4/1977 Wilson et al. .
4,027,450 6/1977 Chiu et al. .
4,094,121 6/1978 Ganholt .
4,140,159 2/1979 Domke .
4,148,933 4/1979 Janovtchik .
4,154,044 5/1979 Lang .
4,458,734 7/1984 Scholle et al. .
4,498,508 2/1985 Scholle et al. .
4,588,000 5/1986 Malin et al. .
4,602,473 7/1986 Hayashi et al. .
4,658,566 4/1987 Sanfilippo .
4,696,226 9/1987 Witmer .
4,703,609 11/1987 Yoshida et al. .
4,733,818 3/1988 Aghnides .
4,768,326 9/1988 Kovacs .
4,791,775 12/1988 Raque et al. .
4,823,680 4/1989 Nowotarski .
4,827,696 5/1989 Arends et al. .
4,831,811 5/1989 Nixon, Jr. et al. .
4,905,454 3/1990 Sanfilippo et al. .
4,941,306 7/1990 Pfaffmann et al. .
4,962,777 10/1990 Bell .
4,964,259 10/1990 Yivisaker et al. .
4,982,555 1/1991 Ingemann .
4,996,071 2/1991 Bell .
5,001,878 3/1991 Sanfilippo et al. .
5,020,303 6/1991 Vokins ..... 53/432
5,054,265 10/1991 Perigo et al. .
5,069,020 12/1991 Sanfilippo et al. .
5,071,667 12/1991 Grüne et al. .
5,121,590 6/1992 Scanlan .
5,159,799 11/1992 Rising et al. .
5,178,841 1/1993 Vokins et al. .
5,201,165 4/1993 Marano et al. ..... 53/432
5,228,269 7/1993 Sanfilippo et al. .
5,230,203 7/1993 Wu et al. .
5,247,746 9/1993 Johnson et al. .
5,323,589 6/1994 Linner .
5,371,998 12/1994 Johnson et al. ..... 53/432
5,417,255 5/1995 Sanfilippo et al. ..... 53/432
5,452,563 9/1995 Marano et al. ..... 53/432
5,473,860 12/1995 Linner ..... 53/432

APPARATUS AND METHOD FOR EXPOSING PRODUCT TO A CONTROLLED ENVIRONMENT

TECHNICAL FIELD

The invention relates to improved apparatus and method for exposing product, including food product, semiconductors, and any product that has an adverse reaction to air, to a controlled environment. More particularly, this invention relates to improved apparatus and process for replacing air in product and/or containers with a desired controlled environment, including inert gas, combinations of gases and other aromas, mists, moisture, etc.

BACKGROUND OF THE INVENTION

Various products including food product, semiconductor products, and any other product that has an adverse reaction to air, are packaged in a controlled environment. Various attempts have been made to efficiently package these products in controlled environments using vacuum and/or controlled environment.

Various food products, including bakery goods, meats, fruits, vegetables, etc. are packaged under atmospheric conditions. Many of these products are presented in supermarkets, for example, in cartons or cardboard containers with a plastic or cellophane wrap covering the product.

One problem with this type of packaging is that the goods have a minimum limited shelf life, which for many products is only several days to a week. With bakery goods for example, mold may begin to grow after a few days under atmospheric conditions. Such products obviously cannot be sold or consumed and must be discarded.

Another problem arises with respect to many fruits and vegetables, which continue to ripen and continue their metabolic process under atmospheric conditions. For example, within a few days a banana can become overripe and undesirable to the consumer.

The space available for gassing operations is often limited at many facilities. In general, existing controlled environment systems are often expensive, bulky, and require three phase power, and, accordingly are impractical for use at many of these facilities.

In an effort to alleviate these problems, various attempts have been made to package food in a controlled environment by injecting controlled environment directly into filled containers. A high velocity flow is often necessary to penetrate into the food product. In general, these attempts have proved unsuccessful. With bakery goods, for example, the high velocity jets pull in air and re-contaminate the product, thereby failing to reduce the oxygen to levels that would prevent the normal onset of mold.

Various techniques for removing air in food filling processes are known in the art. Such processes are used, for example, in the packaging of nuts, coffee, powdered milk, cheese puffs, infant formula and various other dry foods. Typically, dry food containers are exposed to a controlled environment flush and/or vacuum for a period of time, subsequent to filling but prior to sealing. The product may also be flushed with a controlled environment prior to filling, or may be flushed after the filling process. When the oxygen has been substantially removed from the food contents therein, the containers are sealed, with or without vacuum. Various techniques are also known for replacing the atmosphere of packaged meats products with a modified atmosphere of carbon dioxide, oxygen and nitrogen, and/or other gases or mixtures of gases to extend shelf life.

A gas flushing apparatus for removing oxygen from food containers is disclosed in U.S. Pat. No. 4,140,159, issued to Domke. A conveyor belt carries the open top containers in a direction of movement directly below a gas flushing device. The gas flushing device supplies controlled environment to the containers in two ways. First, a layer or blanket of low velocity flushing gas is supplied to the entire region immediately above and including the open tops of the containers through a distributing plate having a plurality of small openings. Second, each container is purged using a high velocity flushing gas jet supplied through a plurality of larger jet openings arranged side-by-side in a direction perpendicular to the direction of movement of the food containers. As the containers move forward, in the direction of movement, the steps of controlled environment blanketing followed by jet flushing can be repeated a number of times until sufficient oxygen has been removed from the containers, and from the food contents therein.

One aspect of the apparatus disclosed in Domke is that the flow of gas in a container is constantly changing. The high velocity streams are directed through perpendicular openings in a plate, which creates eddies near the openings causing turbulence which pulls in outside air. As a container moves past the perpendicular row of high velocity jets, the jets are initially directed downward into the container at the leading edge of the container open top. As the container moves further forward, the flushing gas is directed into the center and, later, into the trailing edge of the open top, after which the container clears the row of jets before being exposed to the next perpendicular row of jets. The process is repeated as the container passes below the next row of jets.

The apparatus disclosed in Domke is directed at flushing empty containers and, in effect, relies mainly on a dilution process to decrease oxygen levels. One perpendicular row of jets per container pitch is inadequate to efficiently remove air contained in food product.

Constantly changing jet patterns in prior art devices create turbulence above and within the containers, which can cause surrounding air to be pulled into the containers by the jets. This turbulence also imposes a limitation on the speed at which the containers pass below the jets. As the containers move faster beneath the jets, the flow patterns within the containers change faster, and the turbulence increases. Also, at high line speeds, purging gas has more difficulty going down into the containers because of the relatively shorter residence time in contact with each high velocity row. The purging gas also has a greater tendency to remain in the head space above the containers. In addition, a perpendicular arrangement of jets relative to the direction of container travel causes much of the jet to be directed outside the containers, especially when the containers are round. Moreover, the spacing apart of the perpendicular rows may further vary the flow pattern and pull outside air into the containers.

It would be desirable to have a gassing system that would replace the air within a container or food product with a controlled environment of higher purity which would greatly increase the shelf life of the product.

SUMMARY OF THE INVENTION

The invention provides apparatus for exposing product to a controlled environment including a distribution chamber, an inlet in the distribution chamber for receiving controlled environment from a source, a region of flow resistance formed in the chamber, and a plurality of jet nozzles positioned adjacent to and surrounded by the resistance region. The nozzles may extend from at least one tube oriented along the flow resistance region. The nozzles may be supplied with controlled environment from a second source. The apparatus may also include a plurality of openings, with diameters larger than the nozzles, formed through the resistance region for allowing the nozzles to extend therethrough. The tube may be connected to a second source of controlled environment. The distribution chamber may have a length, width and height, and the resistance region may be longitudinally oriented in a portion of the chamber. The resistance region may include a portion of screen positioned over longitudinally oriented openings formed in a portion of the distribution chamber, with the nozzles extending through openings formed in the screen. The resistance region may further include a second screen positioned adjacent the first screen and having openings formed therein which are larger than the first screen openings. The resistance region may be separated into a plurality of spaced regions, with each of the spaced regions surrounding one of the jet nozzles.

The invention further provides for a method of operating apparatus for providing product with a controlled environment. A distribution chamber including a region of flow resistance and a plurality of jet nozzles positioned adjacent to and surrounded by the resistance region is provided. High velocity jet streams of controlled environment are supplied through the jet nozzles. Lower velocity streams of controlled environment are supplied through the resistance region. The method further provides that the region of flow resistance may be separated into a plurality of spaced regions, with each of the spaced regions surrounding one of the jet nozzles.

The invention further provides apparatus for removing oxygen from product including a distribution chamber including at least one opening formed therein for allowing a low velocity stream of controlled environment to flow from the opening, and a manifold within the distribution chamber for allowing a plurality of high velocity streams of controlled environment to flow from the manifold while surrounded by the low velocity streams. The apparatus may further include at least one resistance layer substantially covering the distribution opening. The chamber may include a plurality of spaced openings.

The invention further provides apparatus for exposing product to a controlled environment. The apparatus includes a distribution chamber having a length, width and height, and an inlet for receiving controlled environment from a source. A region of flow resistance is longitudinally oriented adjacent a portion of the distribution chamber. A plurality of jet nozzles are oriented parallel the flow resistance region. Each of the nozzles are surrounded by the resistance region. This configuration allows the high velocity flow exiting the jet nozzles to impinge upon and remove air from the food product, while surrounded by the low velocity flow which prevents the jet flow from substantially pulling in outside air to re-contaminate the product. The invention further provides for additional features, including: nozzles extending from at least one tube longitudinally oriented adjacent the flow resistance region; the nozzles being supplied with controlled environment from a second source; a plurality of openings formed through the resistance region for allowing the nozzles to extend therethrough with the openings having a diameter larger than the diameters of the nozzles; the tube being connected to a second source of controlled environment; the resistance region including a portion of screen positioned adjacent longitudinally oriented openings formed in the distribution chamber, the nozzles extending through openings formed in the screen; and the resistance region further including a second screen positioned adjacent the first screen and having openings which are larger than the first screen openings.

The invention further provides for apparatus for exposing product moving along the apparatus to an inert environment including a distribution chamber, resistance sheet, and manifold. The distribution chamber has a length, width and height, and includes a plurality of openings formed in a portion of the chamber. The resistance sheet is adjacent the chamber openings and also has openings that are smaller than and in communication with the chamber openings. The manifold is adjacent the resistance sheet and includes nozzles which extend through the sheet openings. A controlled environment source is connected to the manifold. The apparatus includes other features, including: a second resistance sheet adjacent the first resistance sheet and having openings larger than the first resistance sheet openings, the nozzles extending through both first and second resistance sheet openings; a second controlled environment source connected to the distribution chamber; and the manifold including at least one tube longitudinally oriented along the resistance sheet, the nozzles extending from the tube.

The invention further provides for a gassing system for packaging product in an inert environment including a distribution chamber with first and second sections, a resistance sheet, and a manifold. The distribution chamber is adapted to be positioned along a conveyer moving food product toward a sealer. The chamber has a length, a width, and a height, and a plurality of openings formed therein. The resistance sheet is longitudinally oriented adjacent the chamber openings, and includes a plurality of openings formed on a portion of the sheet adjacent the first section of the chamber. The sheet openings are smaller than and in communication with the chamber openings. The distribution manifold is longitudinally oriented adjacent the resistance sheet and first section of the chamber, and includes a plurality of nozzles extending from the manifold and through the openings formed in the resistance sheet. The system provides other features including: sidewalls along the sides of the conveyor and sides of the distribution chamber; and adjusting members for positioning the distribution chamber from the food product traveling on the conveyor.

The invention also provides a method of exposing product to a controlled environment while traveling along a conveyer to a sealing station. A gas distribution chamber is longitudinally oriented along a conveyer. The product is passed along a first section of the distribution chamber for a period of time. A plurality of high velocity jet streams of controlled environment are supplied from regions longitudinally oriented along the first section of the distribution chamber. Lower velocity streams of controlled environment are supplied through the first section of chamber from regions surrounding the jet streams. The product is then passed along a second section of distribution chamber for a period of time and immediately preceding entry into the sealing station. Lower velocity streams are supplied from the second section of the chamber. Alternatively, a second lower velocity of controlled environment is supplied through the first and second sections of the chamber. Moreover, sidewalls may be provided along sides of the manifold and conveyer.

The invention also provides a method of exposing a product to a controlled environment while moving on a conveyor in a direction of travel. A gas distribution chamber is positioned along the conveyor. The product is passed along the gas distribution chamber for a period of time. A low velocity flow stream of gas is supplied through at least one longitudinally oriented flow resistance region formed in the distribution chamber and parallel to the direction of travel. A high velocity flow stream of gas is supplied through nozzles oriented along the resistance region and extending through and surrounded by the resistance region. Alternatively, there is provided a plurality of resistance regions spaced apart from each other. Alternatively, there is provided a second region of flow resistance, surrounding the first region of flow resistance, for supplying a slightly lower velocity of flow.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
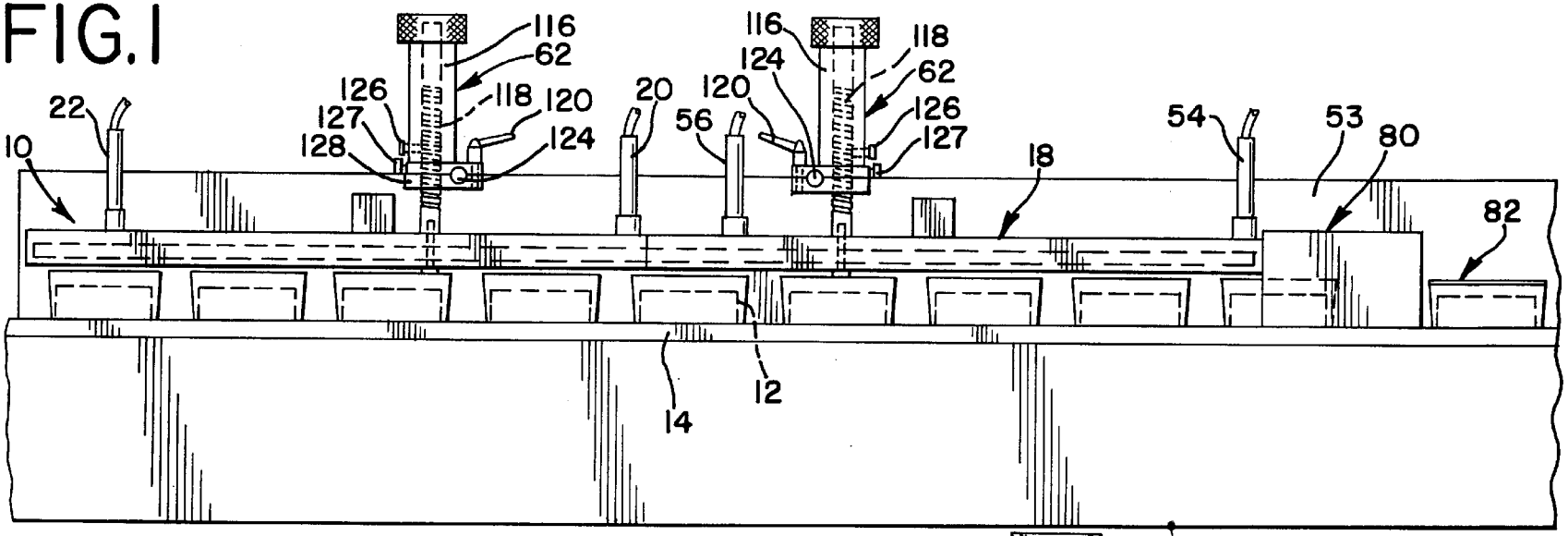
FIG. 1 is a side view of a preferred embodiment of the invention longitudinally disposed along a row of food product being transported by a conveyor.
Figure 2:
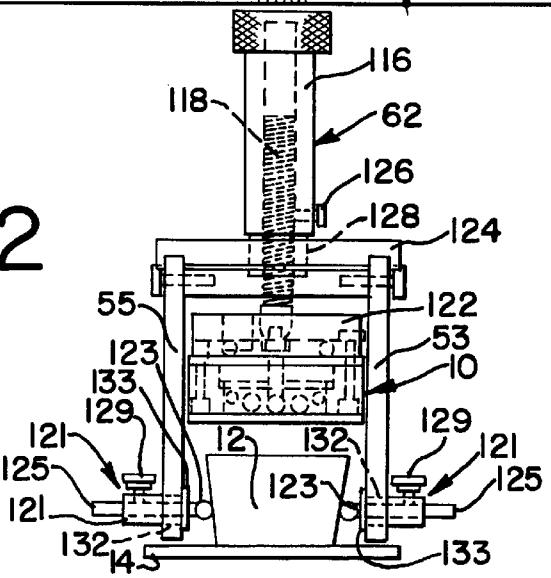
FIG. 2 is an end view of an embodiment, with a sectional view of an adjusting member.

Referring to FIGS. 1 and 2, a preferred embodiment of the gassing system is shown. The gas purging apparatus or gassing rail 10 is disposed along a row of product 12 traveling on a conveyor 14 along rail 10 in a direction of travel designated by arrow 16. In the embodiment of FIG. 1, a gassing rail 10 includes a distribution chamber 18, which in the embodiment shown is composed of two 2 ft. sections 60, 70. The distribution chamber 18 may be positioned in series with other chambers if necessary. In the embodiment of FIGS. 1–5, rail 10 includes a distribution chamber 18 having a height of about 1.325 inches, a length of about 4 ft., and a width of about 4.5–8.0 inches. The controlled environment through the chamber has an inlet and an outlet flow rate of about 2 to about 15 cubic ft. per minute, for this embodiment. The optimum controlled environment flow rate will vary depending on the line speed, product and/or container dimensions.

Figure 3:
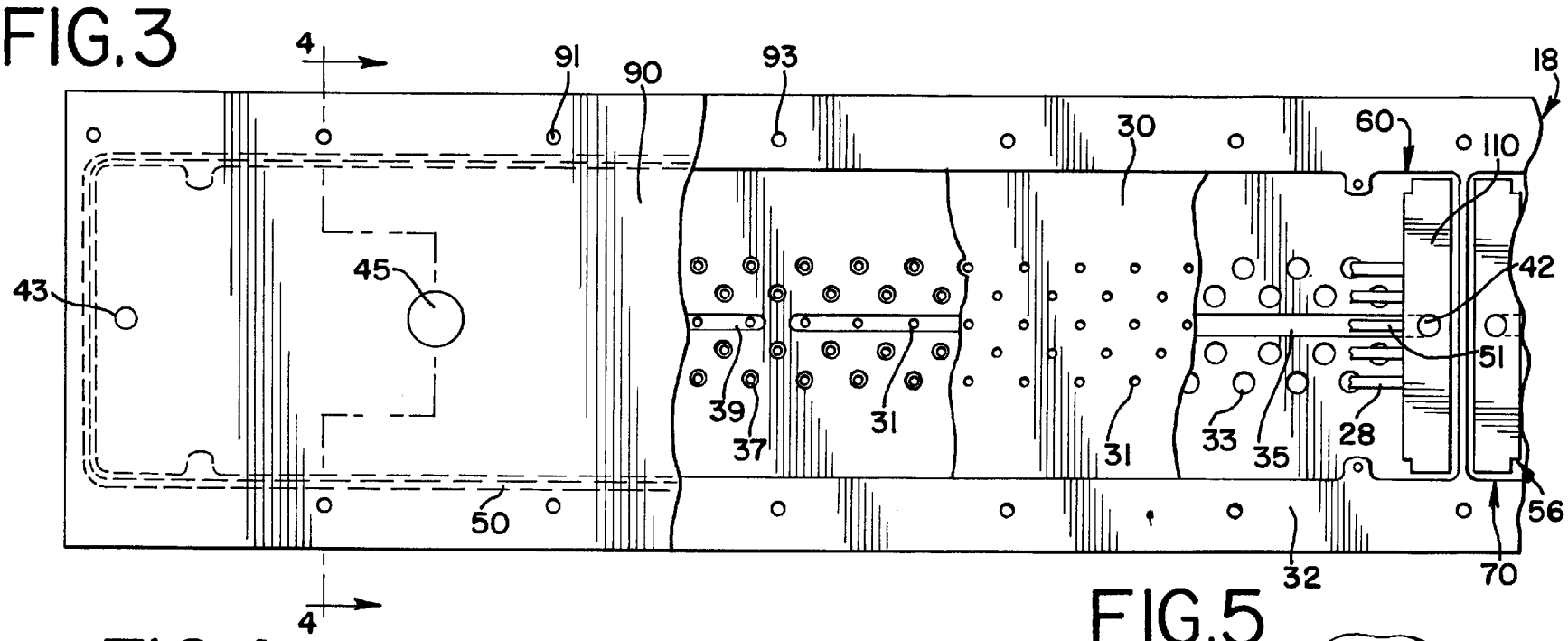
FIG. 3 is a top view of a first section of the embodiment of FIG. 1 with the gassing rail shown in partial section.

Preferably, chamber 18 is closed except for controlled environment inlets 20, 22, 56, 54 formed in its top portion 90, and the openings 33, 35 formed in the its bottom portion 32. Chamber 18 may preferably, be rectangular as shown in FIGS. 1–3, and may be constructed of stainless steel, aluminum, rigid plastic or any other rigid material. Chamber 18 should preferably be at least as wide, and more preferably somewhat wider, than the product or container opening 12. Chamber 18 may also be narrower than the product or container opening, but under certain conditions this may allow outside air to contaminate the product and/or container. Structure or other means may be combined with the narrower chamber to maintain the controlled environment. The length of the chamber 18 may vary depending on the desired line speed and minimum residence time underneath chamber 18 for each container or product 12. Also, a plurality of chambers 18 may be arranged lengthwise in series to create a greater "effective" length. The actual length or number of distribution chambers 19 required will depend on various factors, including conveyor speed, container and product volume, and product type.

For a given residence time, the maximum line speed increases as the length of chamber 18 is increased. For the embodiment described above, a preferred line speed for gassing, for example, most bakery products, is approximately 120 containers per minute (which have, for example, a length of 6 inches, a width of 3.5 inches and a depth of 2.5 inches) (80 ft. per minute of conveyor speed) and requires approximately 16 ft. of effective chamber length.

The height adjusting apparatus 62 provides the operator an efficient means of lowering the rail 10 to a desired level from various sized packages and products. It also allows the rail 10 to be quickly removed for cleaning. The adjusting members 62 each include adjustment knob 116, vertical threaded shaft 118, horizontal mounting shaft 124, base plate 122, horizontal adjustment handle 129, plunger 126, thumb screw 127, and mounting block 128. For the embodiment of FIGS. 1 and 2, the horizontal mounting shaft 124, preferably made of a 6.375 inch, 0.750 inch diameter shaft of stainless steel with 0.5 inch groves formed approximately 0.25 inch from each end with an 82 degree chamfer. Sidewalls 53, 55 are preferably made of a clear plastic material, or polycarbonate, and have a 4 ft. length, a 7 inch height, and a 0.5 inch thickness, which allows the sidewalls 53, 55 to fit within the grooves of the horizontal mounting shaft 124. Various lengths of mounting shafts 124 may be used, and the sidewalls 53, 55 may be adjusted to reduce the internal volume of the tunnel area formed between sidewalls 53, 55. Horizontal mounting shaft 124 slidable fits within an opening formed in mounting block 128, which is also preferably made of stainless steel. Horizontal adjusting handle 120 is used to secure the shaft 124 to mounting block 128, and may be turned to allow the mounting block 128 and thus the rail 10 to be moved in a horizontal direction to an optimal alignment with the conveyer 14 and product 12. Vertical threaded adjusting shaft 118 is screwably received within adjusting knob 116, and fastened to mounting block 128. Shaft 118 is preferably fastened to base plate 122 which is fastened to rail 10. The base plate 122, for the embodiment shown, has a 4.5 inch length and thickness of 0.187 inches, with a center opening communicating with a opening formed in the bottom of the vertical threaded shaft 118, which allows these members to be attached with a screw. The base plate 122 has openings 0.344 inches from its ends for fastening the plate to the rail 10. Plunger 126, which is preferably spring-loaded, may be pulled horizontally outward from its engagement with a groove formed in shaft 118 to allow the operator to make major vertical adjustments to the rail position. The thumb screw 127 may be used to tighten the mounting block 128 and adjusting knob 116. Fine tuning the rail 10 to the precise position above the product 12 may be accomplished by turning adjustment knob 116. For the embodiment of FIGS. 1 and 2, adjusting knob 116 is preferably made of delrin, and is 6.125 inches long with a 4.625 inch long, 1.860 diameter center portion, a 1 inch, 2.5 inch diameter cap portion, and a 0.5 inch, 1.174 inch grooved portion which is received in an opening formed in the mounting block 128. Vertical threaded shaft 118 is preferably made of stainless steel and has a length of 6 inches with an upper grooved portion having a length of 4.75 inches. The shaft has an outer diameter of 0.75 inch with 0.7 inch deep grooves spaced 0.140 inches providing 3 threads per inch. Product positioning members 121 may also be used to maintain alignment of the product 12 under rail 10 as it travels along the conveyer 14. Each of the positioning members 121 includes a receptical 131, a shaft 125, a guide rail 123 and adjuster 129. Guide rail 123 is preferably 4 ft. long with a 0.375 inch diameter and is attached to the inner end of shaft 125. Shaft 125 extends through receptical 131, and may be adjusted by loosening adjuster 129, and then horizontally sliding shaft 125 to the desired position. Receptical 131 has an inner flange portion 133 for retaining the receptical within the opening 132 formed through sidewalls 53, 55.

Preferably, the vertical distance between the bottom of chamber 32 and the product or container is small, and should not exceed about 0.509 inches. Preferably, this vertical distance is between about 0.125 and about 0.250 inches, and most preferably between about 0.175 and about 0.200 inches. These reduced gap distances provide for optimal results with minimum gas usage.

The sidewalls 53, 55 aid in preventing outside air from entering the purging area, and increase the efficiency of the system. The sidewalls 53, 55 also act to force the gas, which includes the air flushed from the container and/or product and controlled environment to exit through the entrance, where the gas may be collected. A gasket 122, including any food-safe sealing material, may also be used in combination with sidewalls 53, 55 to further seal the system from the outside environment.

A horizontal sealing station 80 is preferably positioned at the end of the rail section 70 to achieve the desired controlled environment. Other types of rail and sealing arrangements may also be utilized, including rails, which may run in an upward and/or downward direction, and vertical or rotary sealing stations. Preferably one or more high velocity sections 60 are followed by one or more lower velocity sections 70 prior to sealing the container. However, when sidewalls 53, 54 are used, for example, with a sealer 80 and conveyer 14, which are designed to prevent infiltration of air, a complete rail with high velocity sections may be used, without the need for a low velocity section.

Referring to FIGS. 1–6, the chamber 18 has a top portion 90 and bottom portion 32. Formed in the top portion 90 of chamber section 60 is a first inlet 22 for receiving controlled environment from a first source (not shown) and a second inlet 20 from a second source (not shown). Inlet 22 allows gas to be supplied to the inner cavity 24 of the distribution chamber 18. The second inlet 20 connects to a jet flow tube distribution manifold 26, which includes a rectangular frame 110 which fits over screens 30, 34. Five distribution tubes 28 extend over a plurality of openings 31, 37, 39 formed in screens 34, 30 and openings 33, 35 formed in the bottom portion 32 of the distribution chamber 18.

Figure 5:
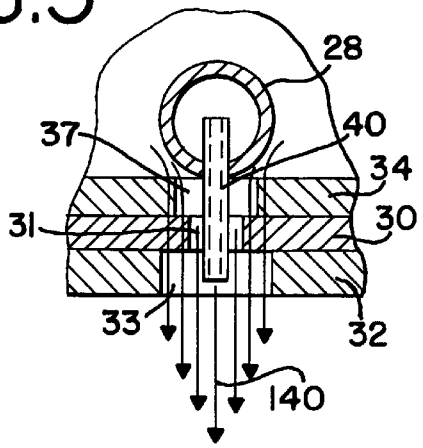
FIG. 5 is an enlarged partial sectional view of the embodiment of FIG. 4 showing a nozzle extending from manifold tubing within the distribution chamber.
Figure 6:
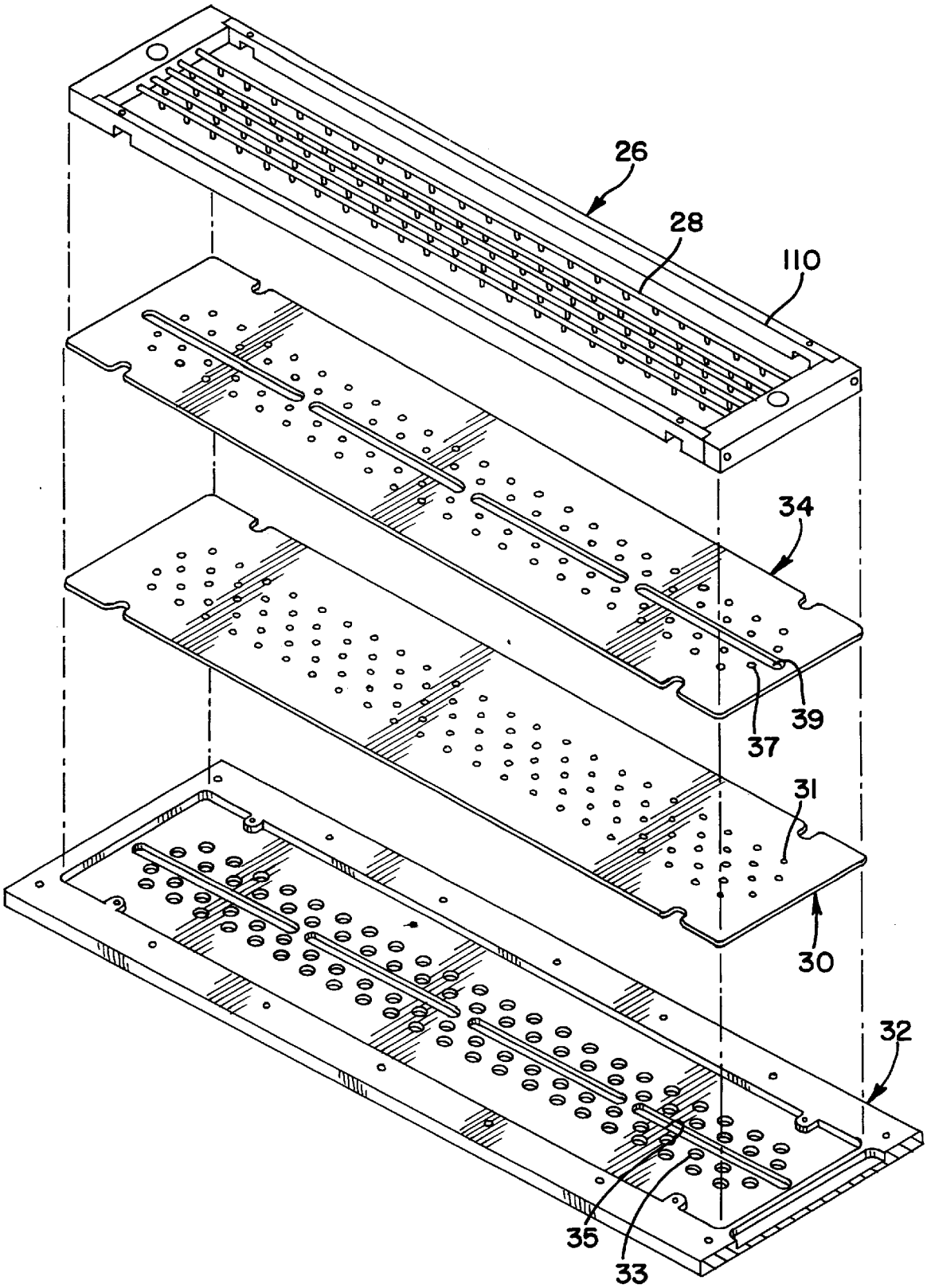
FIG. 6 is an exploded perspective view of a preferred embodiment of the gassing rail.

Referring to FIGS. 3–6, a preferred resistance region includes screens 34, 30 overlying the openings 33, 35 formed in the bottom portion 32 of the distribution chamber. In the embodiment of FIGS. 1–6, equally spaced rows of openings 33 are formed in the bottom of the chamber 32. Center openings 35 are preferably slots having a ⅜inch width. The outside rows are staggered with ⅜inch diameter circular openings 33 spaced 0.938 inch between centers. This arrangement is designed for providing consistent contact of the very high velocity controlled environment streams with the product. The distance between the outer two rows of circular openings may be approximately as wide as the product or container. The bottom portion of the chamber 32 may, alternatively, include greater or lesser number of openings depending on the type of product, line speed, etc. The openings 33 may also be arranged in equally spaced parallel rows, rather than in staggered rows as shown in FIG. 6. Alternatively, the center slots 35 may be formed as one long slot through a section of chamber. Arrangements and number of the openings 33, 35 may be altered to meet the requirements of product with varying sizes and consistencies.

Top screen 34 is preferably formed from a five-ply wire screen having a hole size of between about 10–100 microns. In the above embodiment, the circular openings 37 have diameters of 0.188 inch and center slots 39 with matching 0.188 inch widths. The bottom screen 30 is preferably formed from a 2-ply wire screen having a hole size of preferably 80 microns. The bottom screen 30, in the preferred embodiment of FIGS. 1–5, has preferably 5 staggered rows of circular openings 31 with diameters of 0.125 inches and spaced 0.938 inches between centers.

Figure 15:
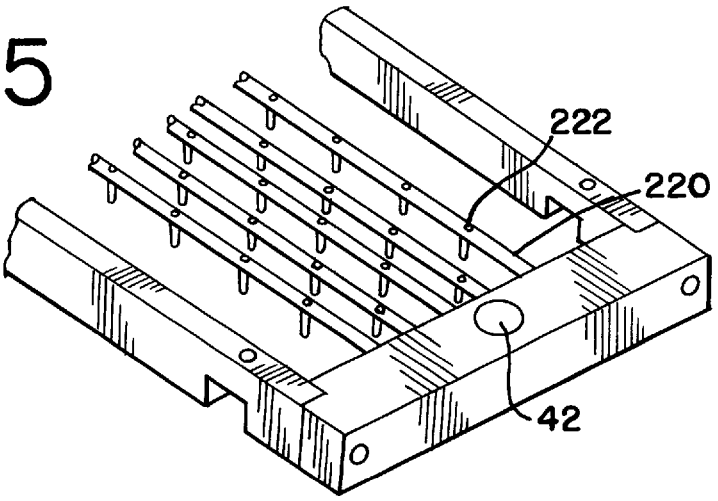
FIG. 15 is an enlarged partial sectional view of an alternative embodiment of the jet manifold including openings for providing controlled environment into the distribution chamber.

As shown in FIGS. 1 and 3, jet manifold 26 is supplied with controlled environment from a second source through inlet 20, which aligns with opening 42. As shown in FIG. 15, alternatively inlet 42 could serve as the sole inlet with an alternative jet manifold design which provides for spaced openings 222 in tubes 220 to allow controlled environment to flow into the distribution chamber 18. The openings may be formed in some or all of the tubes 220, and may be in the top or sides and spaced at varying distances for various product and resistance regions.

Figure 4:
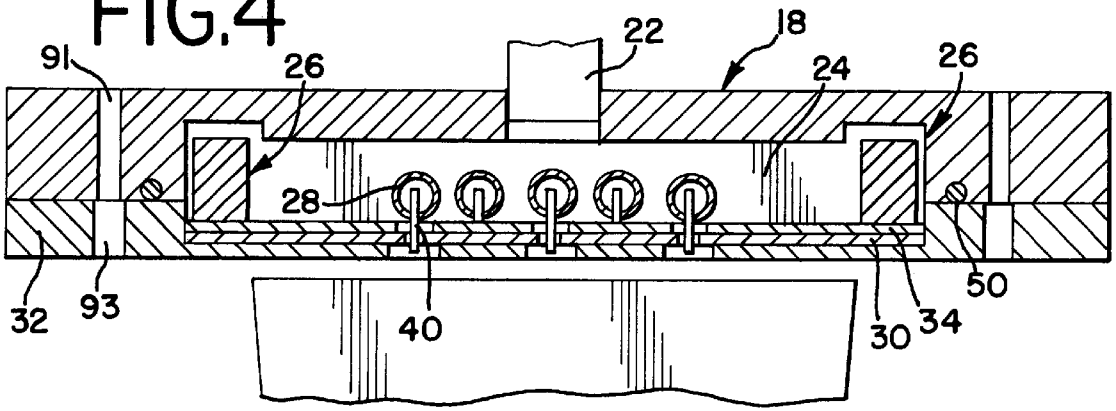
FIG. 4 is a sectional view of the gassing rail taken through line 4—4 of FIG. 3.

As shown in FIGS. 3 and 6, the rectangular frame 110 of the jet manifold 26 fits over the perimeter of the top screen 34. In a preferred embodiment, five tubes 28 extend longitudinally over the rows of openings 37, 39. Extending from the tubes are very high velocity nozzles 40 having an O.D. of approximately 1/16 inch, an I.D. of between about 0.020–0.030 inch, and a length which allows the nozzle to extend through top screen openings 37, 39, and bottom screen opening 31. Preferably, as shown in FIG. 5, the nozzle does not extend beyond the bottom of chamber 32 to facilitate cleaning of the chamber bottom 32 and to avoid damage to nozzles 40 during operation or cleaning. Tolerances of approximately ± or −0.010 inches are held between screens 30, 34 and jet manifold 26 which can be easily removed from the chamber 18 for cleaning. Simpler configurations are possible which do not require close tolerance, but may not be as easily reassembled or mass produced. As shown in FIGS. 3 and 4, chamber 18 is preferably sealed with an O-ring 50, which extends along the perimeter of screens 30, 34 and frame 110 of jet manifold 28 to seal chamber 24. As shown in FIGS. 3 and 4, top portion 90 and bottom portion 32 of the distribution chamber 18 have a plurality of threaded openings 91, 93 spaced along their perimeter for sealing the chamber 18. In the embodiment of FIGS. 3 and 4, O-ring 50 extends around both sections of chamber 60, 70.

In operation, for the embodiment shown in FIGS. 3–5, controlled environment or combination of gases is used, for example, to prolong product freshness or inhibit bacterial growth. The gas enters distribution chamber 18 through inlet 22, which is in communication with opening 45 formed in top portion 90 of chamber 18. The controlled environment flows through screens 34 and 30 and screen openings 31, 37, 39 and chamber openings 33, 35. Simultaneously, controlled environment enters through a second inlet 20 which communicates with opening 42 formed in jet manifold 26, and passes through tubes 28 and nozzles 40. The gas stream from nozzles 40 is of a high velocity, in the range of, for example, 100–1100 ft./sec., or from 100 ft./sec. up to sonic speeds (speed of sound). The high velocity jet flow is designed to impinge upon the product and/or interior of the container as the product is moved along conveyor 14 to sealing station 80. This extremely high velocity flow, will generally, actually penetrate into the product to replace air entrapped within and around the product. The lower velocity, and preferably laminarized flow surrounding the high velocity jet flow substantially prevents outside air from being pulled into the container and/or product.

Figure 7:
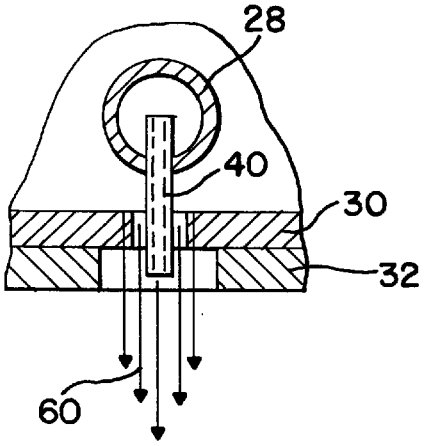
FIG. 7 is an enlarged partial sectional view of an alternative embodiment of the gassing rail.

The gas stream exiting chamber 18 has a much lower velocity. As shown in FIG. 5, the outer region of the flow profile 140 has the lowest velocity because the controlled environment passes through both screens 30, 34. The next region of flow passes only through the bottom screen 30 and has a slightly higher flow velocity. Preferably, the next flow region, which is directly around the nozzle, has no resistance and has a slightly higher velocity than the two outer regions. This flow profile, with a lower velocity flow surrounding the very high velocity flow exiting the jet nozzles 40, substantially prevents outside air from being pulled back into the container and product. The quadruple flow profile, as shown in FIG. 5, may alternatively be modified, as shown in FIG. 7, to a triple flow profile 160 by eliminating the top screen 34. Alternatively, for some product, including nuts, providing flow only through the center slot 28 with one or both screens 30, 34, and the center tube 51 may be adequate to achieve the desired controlled environment for sealing or packaging the product.

Figure 8:
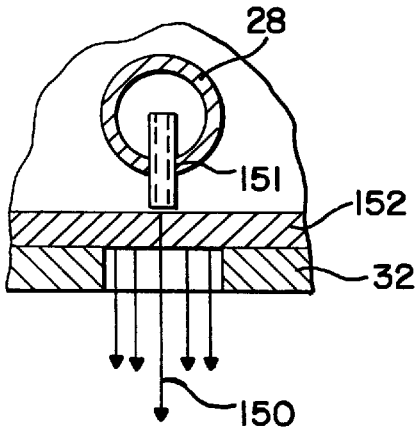
FIG. 8 is an enlarged partial sectional view of an alternative embodiment of the gassing rail
Figure 9:
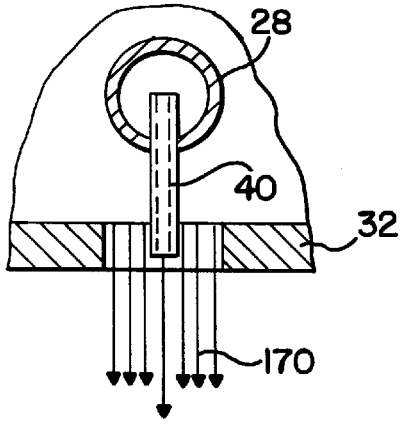
FIG. 9 is an enlarged partial sectional view of an alternative embodiment of the gassing rail.

Alternatively, as shown in FIG. 8, shortened nozzles 151 may be used with a screen 152, which is similar to screen 30 without openings, to provide a dual flow profile 150. Both top and bottom screens 30, 34 may also be eliminated, as shown in FIG. 9 to provide an alternative dual flow profile 170. Various other flow profiles which provide for a lower velocity flow surrounding a very high velocity flow may also alternatively be created by altering the number of screens and openings.

Figure 10:
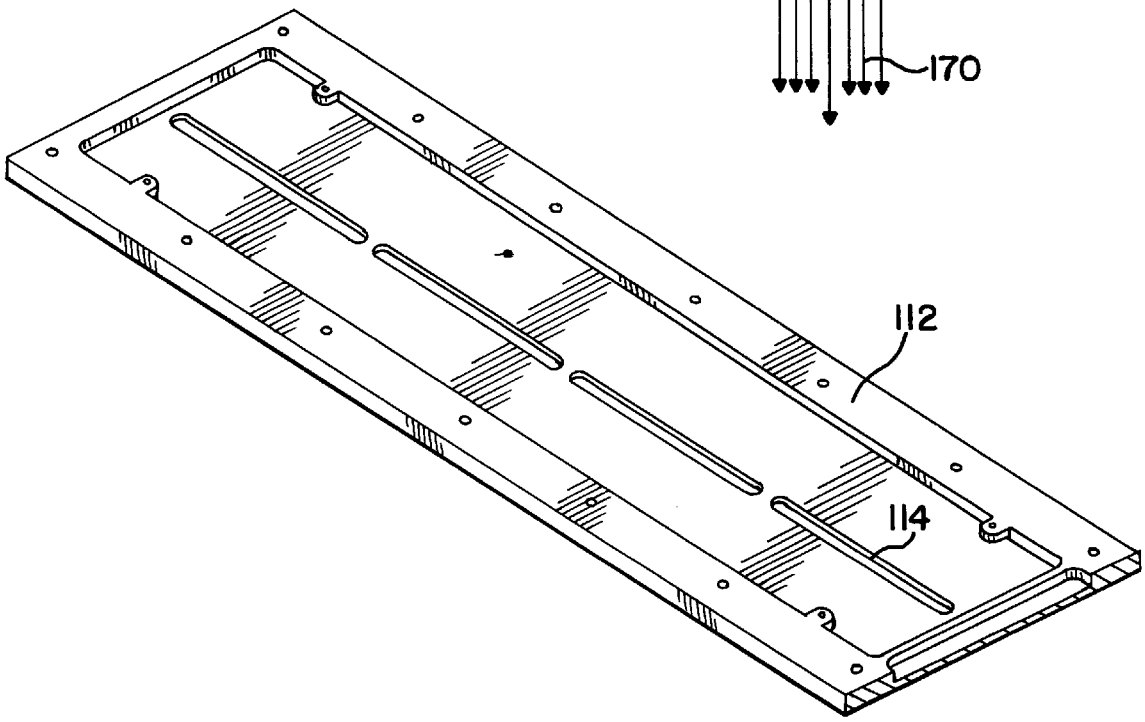
FIG. 10 is a perspective view of an alternative embodiment of a bottom portion of a distribution chamber.
Figure 11:
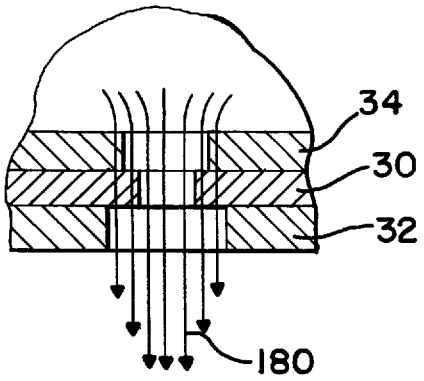
FIG. 11 is an enlarged partial sectional view of an alternative embodiment of a lower velocity section of the gassing rail.
Figure 12:
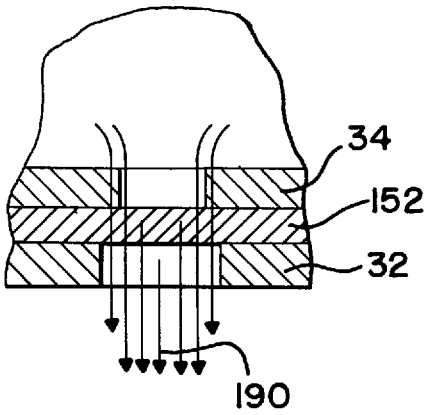
FIG. 12 is an enlarged partial sectional view of an alternative embodiment of a lower velocity section of the gassing rail.
Figure 13:
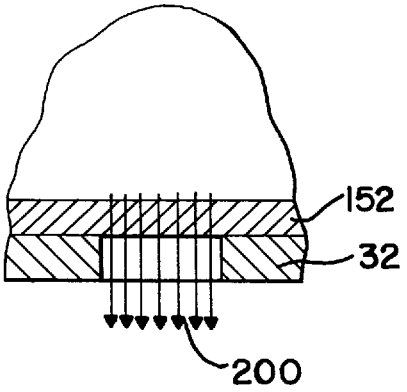
FIG. 13 is an enlarged partial sectional view of an alternative embodiment of a lower velocity section of the gassing rail.
Figure 14:
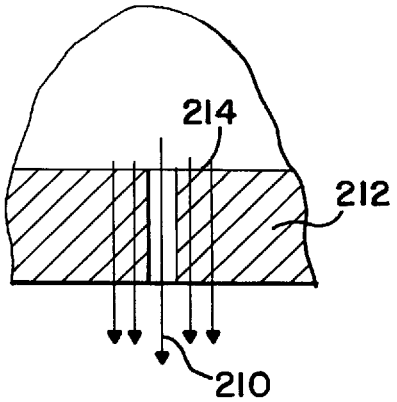
FIG. 14 is an enlarged partial sectional view of an alternative embodiment of a high velocity and/or low velocity section of the gassing rail.

It is preferable for gassing rail 10 to have a distribution chamber or section thereof that provides only a lower velocity flow of controlled environment, preferably a laminarized flow. As shown in FIG. 1. providing a low velocity flow to the section 70 of chamber 18 preceding entry the sealing station 80 aids in preventing air from being pulled into the product or container 12 over the end of chamber 18, which is adjacent the sealing station 80. As shown in FIG. 1, the section 70 may be constructed similar to rail section 60 described above. The desired lower velocity gassing effect is achieved by shutting off the source of controlled environment to inlet 54 which supplies the jet flow tube manifold 56 of rail section 70. Alternatively, section 70 may be altered, as shown in FIG. 10, to have a bottom chamber portion 112 having only slots 114 formed therethrough. Alternatively, as shown in FIG. 11, the jet manifold 26 may be removed altogether to achieve the triple low velocity flow profile 180. Alternatively, as shown in FIG. 12, lower screen 30 may be replaced with screen 152, which has no openings bored therethrough, to create the low velocity flow profile 190. Referring to FIG. 13, the top screen 34 may be removed to provide the single flow profile 200. Other variations of longitudinally oriented regions of flow resistance may be created by altering the number and type of mesh screens, porous materials or other resistance-type sheets. FIG. 14, may be used in either a low or high velocity section. When used in a high velocity flow section, an orifice 214 formed through a resistance material 212, provides high velocity flow. The resistance material 212 is preferably sintered metal-type material, but may be any material that will provide a sufficient reduced velocity flow, and preferably a laminarized flow. With the design of FIG. 14 a jet manifold is not used.

A series of tests were conducted that confirm the desirability of this gassing rail system. Referring to FIG. 1, a 4 ft. gassing rail 10, having two 2 ft. sections 60, 70 was placed on the top of conveyor 14 leaving a clearance of 0.375 inches between the bottom of the chamber 18 and the top of the container 12. The conveyer 14 was operated at 5 inches per second.

One series of tests were conducted with tubs, having 9 inch lengths, and 5.5 inch widths, filled with miniature powdered donuts. The tubs fit into cut-out openings in the conveyer, which allowed for the top of the tubs to be flush with the top of the conveyer. The area beneath the gassing rail was not closed. There were no sidewalls 53, 55 used in this series of tests. In addition, there were openings in the conveyer chain which allowed outside air access to the gas flushing area. After passing through both sections 60, 70 of the gassing rail, the tubs entered a sealing station 80. First a layer of plastic covered the tub openings. Next the plastic sheet was heat sealed to the tub, and then the plastic between tubs was cut. An oxygen sensor was used to determine the oxygen residual in the sealed tubs 82.

In the first test, Test A, nitrogen gas was provided to distribution manifold 18 through inlets 22, 56 and to jet manifolds 26, 56 through inlets 20, 54. The average oxygen residuals for Test A were approximately 2.4 percent. This is an undesirable oxygen residual for many products including baked goods, and would not adequately inhibit mold growth or prevent oxidative rancidity.

In the second test, Test B, the nitrogen gas was fed only through the distribution chamber inlets 22, 56. The source of gas to jet manifold inlets 20, 54 was turned off. The average oxygen residual for Test B was 1.06 percent. This was a better residual than Test A, however, it would also not adequately inhibit mold growth or prevent oxidative rancidity.

A third test, Test C was run under preferred operating conditions. Gas was provided to distribution chamber 18 and jet manifold 26 in the first section 60, and was provided to the distribution chamber only in the second section 70. The gas supply to jet manifold 56 in second section 70 was shut off. This resulted in average oxygen residuals of approximately 0.23 percent. At this level of residual oxygen, mold growth should be substantially, if not, completely inhibited.

Similar tests were run with packages of two chocolate cupcakes. In this series of tests, 16 ft. of rail was used, with the chamber having only center slot openings 35. The two layers of screen 30, 34 having openings 39, 31, as described above, were positioned along the center slot openings 35. Nozzles from jet manifold 26 extended through the screen openings 39, 31, spaced at 2.875 inches between centers. Gas to jet manifold was turned off for a 4 ft. section of rail immediately preceding the sealing station 80. This resulted in average oxygen residuals in the sealed cupcakes of between 0.3 and 0.5 percent. When the gas to the jet manifold was turned off for the entire 16 ft. length of rail, the average oxygen residuals rose to an average range of about 1.6–1.8 percent.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. Apparatus for exposing product to an inert environment prior to packaging comprising:

a distribution chamber;

an inlet in the distribution chamber for receiving controlled environment from a source;

a region of flow resistance formed in the chamber to provide a flow of a first velocity through the resistance region; and a first jet manifold to longitudinally supply controlled environment through the distribution chamber, the first jet manifold including a plurality of jet nozzles each providing a second velocity flow having a higher velocity than the first velocity flow, the second velocity flow being flowed in a direction outward from the manifold and at an angle to the longitudinal supply of controlled environment, the second velocity flow from each nozzle being completely surrounded and isolated from any other of the nozzles by the first velocity flow to allow the product to be contacted by the high velocity flow without pulling in air.

2. The apparatus of claim 1 wherein the jet manifold includes at least one tube longitudinally oriented along the flow resistance region, the nozzles extending substantially perpendicular from the tube.

3. The apparatus of claim 1 wherein the jet manifold is supplied with controlled environment from a second source.

4. The apparatus of claim 1 further comprising a plurality of openings formed through the resistance region for allowing the nozzles to extend at least partially therein, the resistance region openings including diameters larger than the diameters of the nozzles.

5. The apparatus of claim 4 wherein the nozzles extend from at least one tube oriented along the resistance region.

6. The apparatus of claim 5 wherein the tube is connected to a second source of controlled environment.

7. The apparatus of claim 1 wherein the distribution chamber has a length, width and height, and the resistance region is longitudinally oriented in a portion of the chamber.

8. The apparatus of claim 7 wherein the resistance region comprises a portion of screen positioned adjacent longitudinally oriented openings formed in a portion of the distribution chamber, the nozzles extend through openings formed in the screen.

9. The apparatus of claim 8 wherein the resistance region further comprises a second screen positioned adjacent the first screen and having openings formed therein which are larger than the first screen openings.

10. The apparatus of claim 1 wherein the region of flow resistance comprises a plurality of spaced regions, each of the jet nozzles encircled by one of the spaced regions.

11. Apparatus for exposing product moving along the apparatus to an inert environment prior to packaging comprising:

a distribution chamber having a length, width and height, and including a plurality of openings formed in a portion of the chamber;

a resistance sheet covering the chamber openings, the resistance sheet including a plurality of openings formed therein, the sheet openings are smaller than and in communication with the chamber openings; and a longitudinally oriented manifold adjacent the resistance sheet to longitudinally supply controlled environment to a plurality of nozzles positioned along the length of the manifold and aligned with the sheet and chamber openings, the nozzles oriented at an angle to the manifold to direct high velocity flow of controlled environment toward the product while lower velocity flow is also directed toward the product through portions of the chamber openings encircling and isolating each of the nozzles.

12. The apparatus of claim 11 further comprising a second resistance sheet adjacent said first resistance sheet, the second resistance sheet having openings larger than the first resistance sheet openings, the nozzles extending through both first and second resistance sheet openings.

13. The apparatus of claim 11 further comprising a second controlled environment source connected to the distribution chamber.

14. The apparatus of claim 11 wherein the manifold comprises at least one tube longitudinally oriented along the resistance sheet, the nozzles extending from the tube.

15. A method of exposing product to a controlled environment while traveling along a conveyor to a sealing station, comprising the steps of:

providing a gas distribution chamber longitudinally oriented along a conveyor and including a plurality of openings formed therein, the distribution chamber including a first section and a second section, the second section positioned adjacent the sealing station, the first section including a longitudinally oriented manifold, the manifold including a plurality of nozzles positioned along the manifold and at an angle to the manifold, each nozzle aligned with an opening formed in the first section of the chamber;

passing the product along a first section of the distribution chamber for a period of time;

supplying a plurality of high velocity jet streams of controlled environment from the nozzles which are positioned along the first section of the distribution chamber;

supplying lower velocity streams of controlled environment through the openings formed in the first section of the chamber from regions encircling and isolating each of the high velocity jet streams;

passing the product along a second section of the distribution chamber for a period of time and immediately preceding entry into the sealing station; and supplying lower velocity streams of controlled environment through the openings formed in the second section of the chamber.

16. The method of claim 15 further comprising:

supplying a second lower velocity stream of controlled environment through the openings formed in at least the second portion of the chamber.

17. The method of claim 15 further comprising providing sidewalls on sides of the rail and conveyor, adjusting the sidewalls to reduce the internal volume of a space formed between the sidewalls.

* * * * *